US007081891B2

(12) United States Patent
Schermerhorn

(10) Patent No.: US 7,081,891 B2
(45) Date of Patent: Jul. 25, 2006

(54) METHOD AND APPARATUS FOR RESONANT INJECTION OF DISCHARGE ENERGY INTO A FLAT PLASMA DISPLAY PANEL

(75) Inventor: Jerry D. Schermerhorn, Perrysburg, OH (US)

(73) Assignee: LG Electronics, Inc., Seoul (KR)

( * ) Notice: Subject to any disclaimer, the term of this patent is extended or adjusted under 35 U.S.C. 154(b) by 473 days.

(21) Appl. No.: 10/329,278

(22) Filed: Dec. 23, 2002

(65) Prior Publication Data

US 2003/0137472 A1 Jul. 24, 2003

Related U.S. Application Data

(60) Provisional application No. 60/344,246, filed on Dec. 28, 2001.

(51) Int. Cl.
*G09G 3/28* (2006.01)
*G09G 5/00* (2006.01)

(52) U.S. Cl. ..... 345/211; 345/60; 345/66

(58) Field of Classification Search ..... 345/60–67, 345/211, 204; 315/169.1–169.4; 363/125
See application file for complete search history.

(56) References Cited

U.S. PATENT DOCUMENTS 3,559,190 A 1/1971 Bitzer et al.
4,180,762 A 12/1979 Weber
4,333,039 A * 6/1982 Strom ..... 345/60
4,550,274 A 10/1985 Weber
4,772,884 A 9/1988 Weber et al.
4,866,349 A 9/1989 Weber et al.
4,924,218 A 5/1990 Weber et al.
5,081,400 A 1/1992 Weber et al.
5,642,018 A 6/1997 Marcotte
5,717,437 A 2/1998 Sano et al.
5,943,030 A * 8/1999 Minamibayashi ..... 345/60
5,966,106 A * 10/1999 Yamazaki ..... 315/169.3
6,111,556 A * 8/2000 Moon ..... 345/60
6,333,738 B1 12/2001 Ide
6,448,946 B1 9/2002 Anderson et al.
6,563,272 B1 * 5/2003 Dufort ..... 315/169.3
6,803,889 B1 * 10/2004 Onozawa et al. ..... 345/60
2003/0030632 A1 * 2/2003 Choi ..... 345/211
2003/0099122 A1 * 5/2003 Cho ..... 363/125

FOREIGN PATENT DOCUMENTS

EP 1 152 387 A1 11/2000
EP 1 160 756 A1 12/2001

* cited by examiner

*Primary Examiner*—Bipin Shalwala
*Assistant Examiner*—David L. Lewis
(74) *Attorney, Agent, or Firm*—MacMillan, Sobanski & Todd, LLC

(57) ABSTRACT

An improved sustainer voltage waveform driver circuit for a flat plasma display panel that includes a pair of series connections of an electronic switch coupled to the plasma panel via an inductor. The driver injects energy required both to supply plasma discharge current within the PDP and to accomplish a voltage transition in a resonant manner.

34 Claims, 9 Drawing Sheets

METHOD AND APPARATUS FOR RESONANT INJECTION OF DISCHARGE ENERGY INTO A FLAT PLASMA DISPLAY PANEL

CROSS REFERENCE TO RELATED APPLICATIONS

This application claims the benefit of U.S. Provisional Application No. 60334246 filed Dec. 28, 2001.

BACKGROUND OF INVENTION

This invention relates in general to flat plasma display panels and in particular to a method and apparatus for resonant injection of discharge energy into a flat plasma display panel.

Flat plasma display panels, or gas discharge panels, are well known in the art and generally have a structure that includes a pair of substrates that are in a spaced relationship to define a gap therebetween. Ionized gas is sealed in the gap. Additionally, parallel column and row electrodes are deposited upon the surfaces of the substrates and coated with a dielectric material such as a glass material. The substrates are arranged with the electrodes in an orthogonal relation to one another to define points of intersection. The points of intersection in turn define discharge cells at which selective discharges may be established to provide a desired storage or display function.

It is also known to operate such panels with alternating voltages and particularly to provide a write voltage which exceeds the firing voltage at a given discharge point, as defined by a selected column and row electrode, to produce a discharge at a selected cell. The discharge at the selected cell can be continuously "sustained" by applying an alternating voltage. However, the alternating voltage by itself is insufficient to initiate a discharge. The technique relies upon wall charges generated upon the dielectric layers of the substrates which, in conjunction with the sustain voltage, operate to maintain discharges.

Details of the structure and operation of flat plasma display panels are set forth in U.S. Pat. No. 3,559,190 that issued on Jan. 26, 1971.

Referring now to FIG. 1, there is shown generally at 10, a schematic diagram for a known driver circuit 12 for providing a sustaining voltage to a flat Plasma Display Panel (PDP) 14. The PDP 14 is represented in FIG. 1 by a plurality of capacitors 15 and a panel inductor 16 enclosed within a dashed rectangle. The sustainer driver 12 for a TS PDP is required to make a 600-V transition with a 200-ns rise time. This has traditionally been done using a series-resonant network, split into two series-resonant sections, as shown in FIG. 3, with each series-resonant section driving one end of the sustainer capacitance of the PDP 14. As shown in FIG. 1, each series-resonant section is composed of an driver inductor 17 plus a series combination of a MOSFET (IRF740) 18 and a pn diode (MUR1540) 20. The left portion of the driver section 12 is connected through a driver capacitor 22 to ground while the right portion of the driver section 12 is connected between a power supply 24 and ground. A first driver diode 26 is connected between the input to the PDP 14 and the power supply 24 while a second driver diode 28 is connected between the input to the PDP 14 and ground.

The operation of the driver circuit 10 is illustrated in FIGS. 2 and 2A. The MOSFET's are sequentially switched between conducting and non-conducting states by a logic circuit (not shown). As the driver section 12 operates, charge flows through the driver inductance 17 and back and forth between the PDP 14 and driver capacitance 22. The combined inductors and capacitors of the driver section 12 and the PDP 14 form a resonant circuit. As shown in FIG. 2, a resonant transition is then expected to be a half-wave pulse of current, driving the sustainer capacitance of the PDP panel 14 through most of its voltage transition, which is then completed by the loose turn-on of clamping MOSFET's (IRFP360), which are also expected to carry the sustainer discharge current. The resonant loop on any given resonant transition therefore includes two IRF740's, 18, two MUR1540's, 20, two resonant inductors 16 and 17, and the sustainer capacitance 15, all in series. The bottom curve in FIGS. 2 and 2A represents the sustaining voltage applied to the PDP 14 while the middle curve represents the current flowing through the driver inductor 17 and the upper curve represents the current supplied by the clamp in the driver circuit. As shown in FIG. 2, the clamp occurs after the ramp up. This requires a fast voltage ramp up time in order to complete the sequence in the allocated time. Because of the fast voltage ramp up, ringing can occur, as also is apparent in FIG. 2. At time $t_{return}$, the driver operates in a similar manner to return the sustainer voltage to the original voltage level.

It has been found that the driver section 12 shown in FIG. 1 recovers about 90% of the energy normally lost in driving the panel capacitance 15. Accordingly, a PDP using the circuit shown in FIG. 1 can operate with only about 10% of the power required by earlier prior art PDP's. Further details of the sustainer driver circuit are included in U.S. Pat. No. 5,081,400 that issued on Jan. 14, 1992. A complete sustainer driver circuit is shown in FIG. 3, where both driver sections 12 and 26 are illustrated. Components shown in FIG. 3 that are similar to components shown in FIG. 1 have the same numerical identifiers. The driver section 12 on the left in FIG. 2 is operative to raise the sustaining voltage while the driver section 26 on the right in FIG. 3 is operative to return the sustaining voltage to the original level.

Further details of the structure and operation of the above described sustaining voltage supplies are set forth in U.S. Pat. No. 4,866,349 that issued on Sep. 12, 1989.

The prior art sustainer voltage driver circuits are complex and require a number of switching FET's. Accordingly, it would be desirable to provide a simpler driver circuit that would include less expensive components.

SUMMARY OF INVENTION

This invention relates to a method and apparatus for resonant injection of discharge energy into a flat plasma display panel.

The present invention is directed toward a sustainer voltage driver circuit for a flat plasma display panel that includes a driver inductor having at least a first end and a second end, the second end of the inductor being adapted to be connected to an input port of the flat plasma display panel. The driver circuit also includes a first electronic switch connected to the first end of the driver inductor and a second electronic switch also connected to the first end of the driver inductor. The circuit further includes at least one variable voltage supply connected across the first and second electronic switches. A first driver capacitor is connected between the second electronic switch and ground and a second driver capacitor is connected between the second electronic switch and a voltage feedback point. A first driver diode is connected between the second end of the driver inductor and the voltage feedback point and a second driver diode is connected between the second end of the driver inductor and ground. The driver circuit also includes a logic circuit connected to and operative to control the first and second electronic switches and the variable voltage supply.

The logic circuit is also is connected to said feedback point and is responsive to the voltage level at said voltage feedback point to adjust the output voltage level of said voltage supply. Furthermore, the logic circuit is operative to set the variable voltage supply at an appropriate level to inject sufficient energy during a transition of a sustaining voltage to a resonant condition to establish a plasma discharge within the flat plasma display panel In the preferred embodiment, the first and second electronic switches include a series connection of an IGBT and a diode. Additionally, when connected to a plasma display panel the driver circuit resonates with the panel such that the total power required to operate the panel is reduced.

The present invention also contemplates a method of driving a flat plasma display panel that includes the steps of providing a driver circuit that includes at least one adjustable voltage supply. An energy requirement for the display panel is then determined and the voltage supply levels are set to correspond to the desired energy requirement. The transition to the a resonant condition for the sustaining voltage is begun and, if desired, sufficient energy is supplied to the panel during the transition stage to establish a plasma discharge within the flat plasma display panel.

The present invention also contemplates an alternate embodiment of the driver circuit for a flat plasma display panel that includes a first switching device having a first end and a second end with the first end adapted to be connected to a sustaining voltage supply. The driver circuit further includes a transformer having a primary winding and a secondary winding. The transformer primary winding having first and second ends with the first end connected to the second end of the first switching device and the second end, said first end of said primary winding being, said second end of said primary winding being adapted to be connected to a sustaining voltage input port of the flat plasma display panel. Additionally, the driver circuit includes a second switching device connected across the transformer secondary winding. The first and second switching devices being selectively switched between conducting and non-conducting states such that energy is stored in a field generated by the transformer windings for injection into the plasma display panel.

The invention further contemplates that the injected energy is sufficient to both transition the voltage across the flat plasma display panel to a desired sustainer voltage level and to provide current to initiate the desired gas discharges within the flat plasma display panel The present invention also contemplates a method for operating the alternate embodiment of the driver circuit described immediately above. The method for operating includes the steps of placing the first switching device in a conducting state while the second switching device is in a non-conducting state to cause a voltage to begin to increase at a generally increasing rate upon the display panel. The first switching device in then placed in a non-conducting state while the second switching device is in a non-conducting state to cause the voltage upon the display panel to continue to increase at a generally constant rate. Next, the first switching device is returned to a conducting state while the second switching device is also placed in a conducting state to cause the voltage upon the display panel to continue to increase at a slower rate and to be clamped at predetermined voltage level while energy is stored within the B-field established in the transformer coils by the flow of current within the transformer secondary coil. The first switching device is then placed in a non-conducting state while the second switching device remains in a conducting state to continue to store energy within the B-field established in the transformer coils by the flow of current within the transformer secondary coil. Finally, the second switching device is returned to a non-conducting state to inject the stored energy into the display panel while maintaining the voltage applied to the flat plasma display panel at essentially a clamped voltage level.

Various objects and advantages of this invention will become apparent to those skilled in the art from the following detailed description of the preferred embodiment, when read in light of the accompanying drawings.

DETAILED DESCRIPTION

Figure 1:
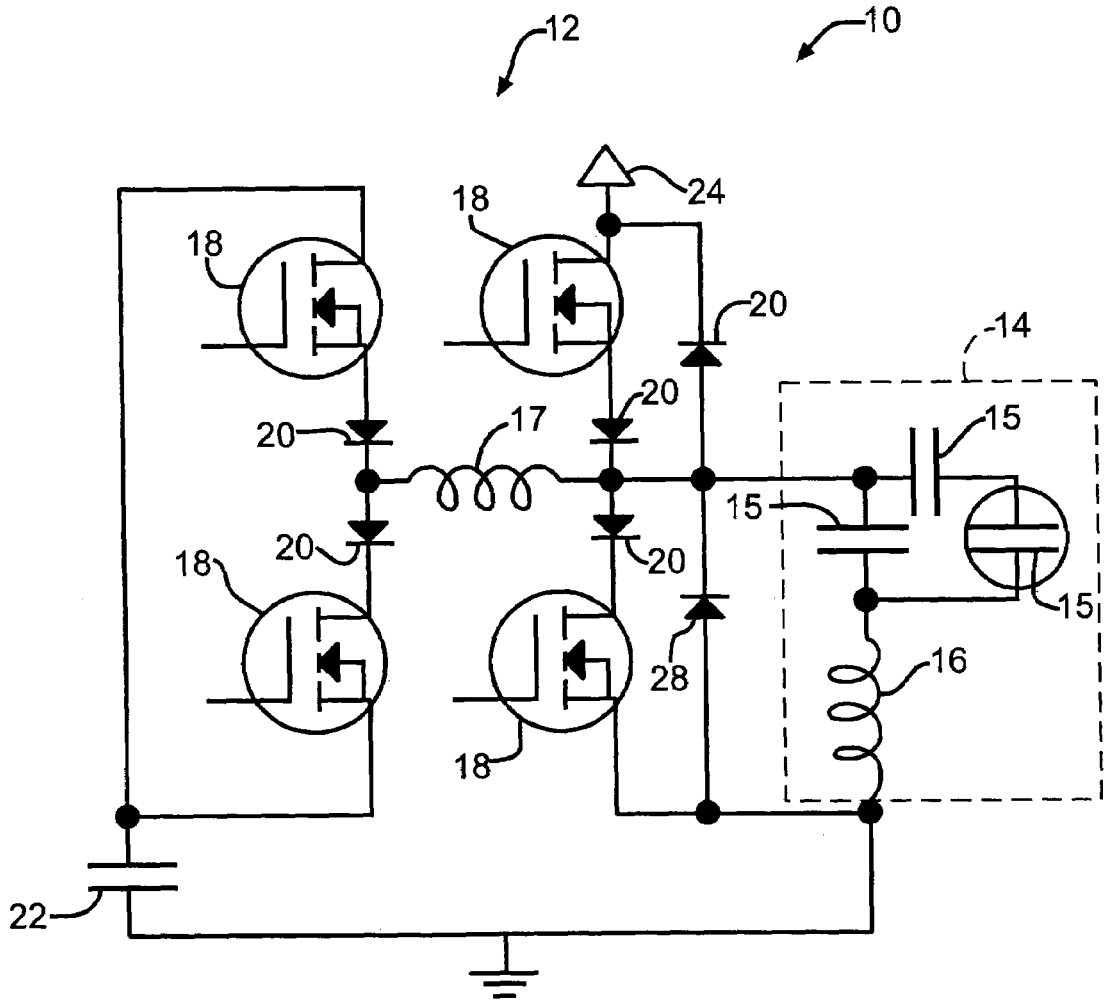
FIG. 1 PRIOR ART
FIG. 1 is a schematic circuit diagram for a section for a prior art driver circuit for supplying a sustaining voltage to a flat plasma display panel.
Figure 4:
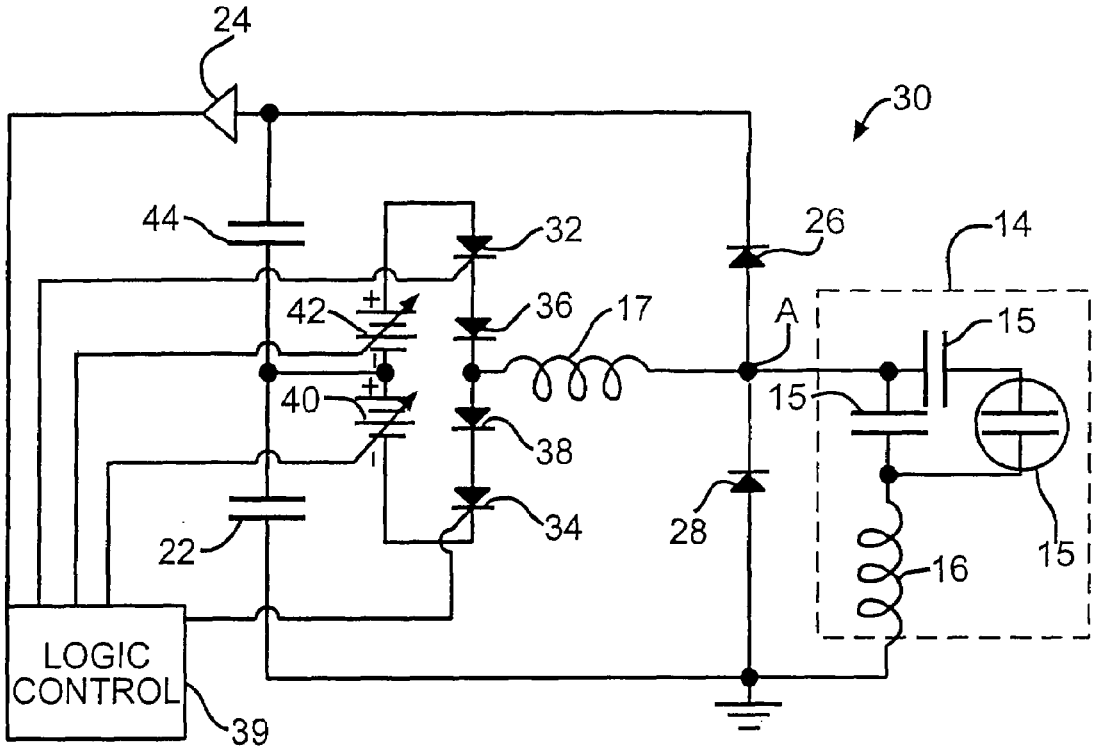
FIG. 4 is a schematic diagram for a section of a driver circuit for supplying a sustaining voltage to a flat plasma display panel in accordance with the invention.

Referring again to the drawings, there is illustrated in FIG. 4 an improved circuit 30 for a section of a PDP sustainer voltage driver. Components shown in FIG. 4 that are similar to components shown in FIG. 1 have the same numerical identifiers. As shown in FIG. 4, the four MOSFET'S 18 of the prior art driver circuit 12 have been replaced with first and second Injection Gate Bipolar Transistors (IGBT's) 32 and 34 that are sequentially switched between conducting and non-conducting states by a logic control circuit 39. In the preferred embodiment, IRG4BC40W IGBT'S are used. The IGBT's 32 and 34 were identified as more promising than the MOSFET's 18 for use in the resonant drive circuit because their on-state voltage drops do not increase proportionately with increasing conduction current. Because of the resonant circuit, the turn-off times of the IGBT's 32 and 34 are not an issue. While the preferred embodiment of the invention is illustrated as using IGBT's, it will be appreciated that the invention also can be practiced with other conventional electronic switches, such as FET's, bipolar transistors or the like.

The first IGBT 32 has a cathode that is connected to the anode of a first MUR diode 36. In the preferred embodiment, MUR1540 diodes are used. The cathode of the first MUR diode 36 is connected to a first end of the driver inductor 17. The anode of the second IGBT 34 is connected to the cathode of a second MUR diode 38. The anode of the second MUR diode 38 is also connected to the first end of the driver inductor 17.

The cathode of the second IGBT 34 is connected to the negative terminal of a series combination of two variable voltage supplies 40 and 42 while the anode of the first IGBT 32 is connected to the positive terminal of the combined voltage supplies 40 and 42. The variable voltage supplies 40 and 42 are conventional programmable voltage supplies such as, for example, flyback transformers, buck-up power supplies, flyback voltage sources or the like. The voltage supplies 40 and 42 are connected to and controlled by the logic control 39. As will be described below, the voltage supplied by the supplies 40 and 42 varies from about one quarter of the sustainer voltage when no plasma discharges are present to an elevated level that is a function of the amount of energy required to initiate a plasma discharge.

The series connected diodes 36 and 38 provide a turn-off function for the IGBT's 32 and 34. As described above, the cathode of the first diode 36 and the anode of the second diode 38 are connected to a first end of the driver inductor 17. The second end of the driver inductor 17 is connected to the input port A of the PDP 14. While the driver inductor 17 is illustrated as having two end connections, it will be appreciated that the invention also may be practiced with a driver inductor having one or more taps between the first and second ends thereof (not shown). The intermediate taps on such an inductor would allow connection of conventional circuits to boost the voltage applied to the PDP input port A.

The connection between the two variable voltage supplies 40 and 42 is connected to a common node between first and second driver capacitors 22 and 44. The first driver capacitor 22 is also connected to ground while the second driver capacitor is connected to the voltage feedback point 24. Similar to the prior art driver circuit 12 described above, the driver circuit 30 also includes a first driver diode 26 that is connected between the input port A of the PDP 14 and the voltage feedback point 24 while a second driver diode 28 is connected between the input port A and ground.

Figure 5:
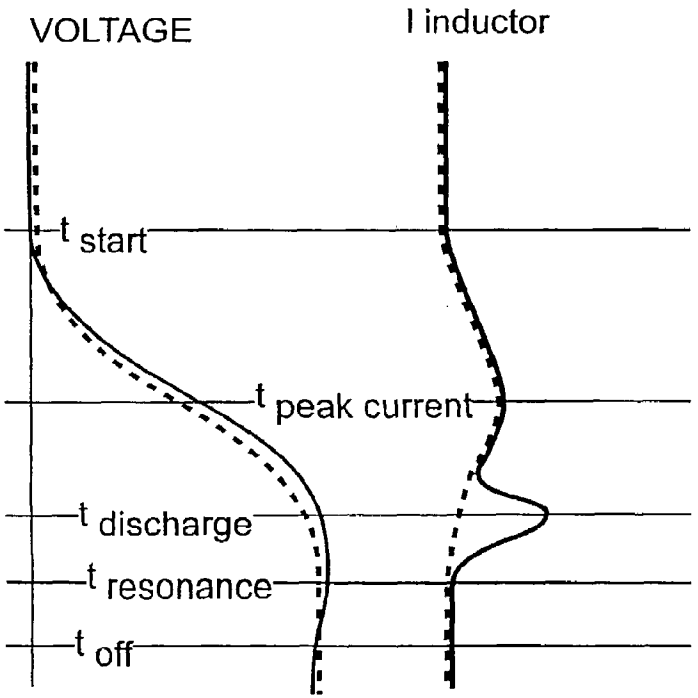
FIG. 5 illustrates voltage and current waveforms generated by the driver circuit shown in FIG. 4.

The operation of the improved driver circuit 30 will now be described. Typical waveforms generated by the operation of the circuit 30 are shown in FIG. 5. The operation is also illustrated by the flow chart in FIG. 5A. The present invention contemplates two modes of operation of the PDP 14. In a first mode, which is illustrated by the broken lines in FIG. 5, there is no plasma discharge. In the second mode, which is illustrated by the solid lines in FIG. 5, there is a plasma discharge.

Figure 5A:
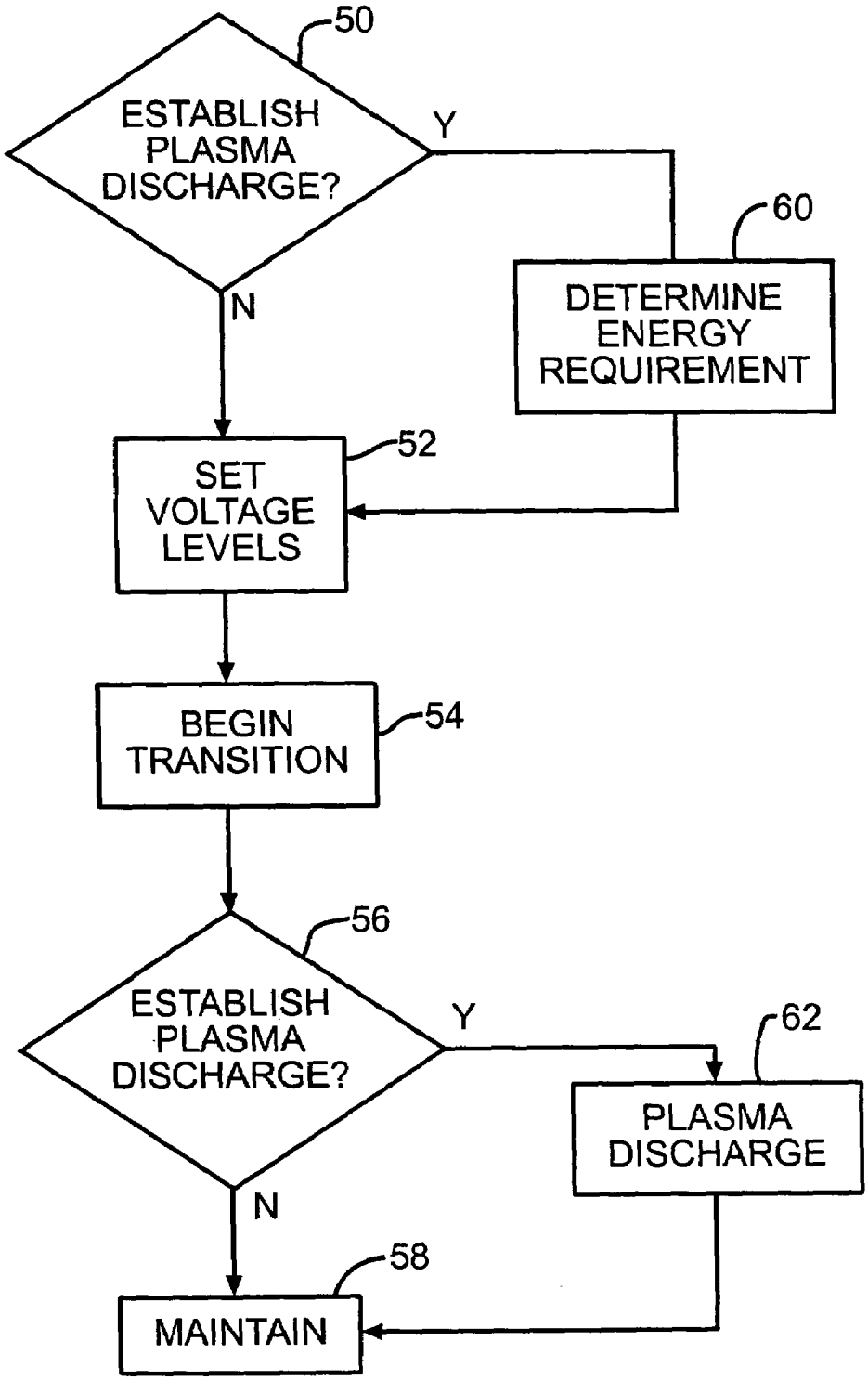
FIG. 5A is a flow chart for the operation of the driver circuit shown in FIG. 4.

In decision block 50 in FIG. 5A, it is determined which mode of operation is desired. Assuming the first mode, the method proceeds to functional block 52 where the voltage levels for the variable voltage supplies 40 and 42 are set at approximately one quarter of the sustaining voltage level. Ideally, the voltages would be at one quarter of the sustaining voltage level; however, due to the need to compensate for component losses, the voltage levels are actually set slightly above the one quarter voltage level. At this point, the voltage at the PDP input port A is at ground or zero potential. At $t_{start}$ the first electronic switch 32 is changed from a non-conducting state to a conducting state, as shown in functional block 54. The series resonance of the driver inductor 17 and the parallel capacitors 15 of the PDP 14 establish a resonant rise in voltage at the input port A. The time constant for the voltage rise is determined by the total inductance of the driver inductor 17 and the panel inductor 16 and the capacitance of the panel capacitors 15. The current through the driver inductance 17 reaches a peak at $t_{peak\ current}$ after which the current begins to decrease as the voltage continues to rise. The voltage reaches a peak at $t_{resonance}$. As shown in FIG. 5A, because the first mode is in effect, the operation continues through decision block 56 to functional block 58 where the first electronic switch 32 is returned to its non-conducting state at $t_{off}$ with the voltage at the sustaining voltage level. Once the intended sustaining voltage is reached, it is held by the operation of the driver diode 26 and the PDP capacitors 15.

After a predetermined time has elapsed, the second electronic switch 34 is changed to a conduction state (not shown) The second electronic switch cooperates with the driver inductor 17 and the PDP panel capacitance in a similar manner as described above to drive the sustaining voltage back to its original value (not shown).

The second mode of operation includes establishment of a plasma discharge. Accordingly, the operation transfers from the decision block 50 to 60 where the logic control 39 determines the energy requirement to establish the desired plasma discharge. Then the voltage levels are set in functional block 52 at a higher level to cause an injection of additional energy during the transition to resonance of the PDP 17. As shown by the lower solid curve in FIG. 5, the voltage increases at a faster rate since the voltage supplies 40 and 42 are set for higher outputs. Because of the increased energy, a plasma discharge is established at $t_{discharge}$, as illustrated in FIG. 5. After the discharge is established, the sustaining voltages are maintained as described above. However, if the voltage supply voltages were set too high, the driver conductor 26 will conduct slightly and charge driver capacitor 44. The voltage appearing across the capacitor 44 is fed back from point 24 to the logic control 39 which then adjusts the voltage levels in a downward direction for the next cycle. Thus, the setting of the voltage outputs for the voltage supplies 40 and 42 is dynamic. Also, the present invention injects energy during the transition to resonance for the PDP sustaining voltage. Because the injection of energy occurs during the transition, the transition can last longer, thereby reducing the amount of total energy required to operate the PDP 17. Also, as described above, a single driver circuit 30 is capable of driving the PDP with two sustaining voltage levels.

Figure 2A:
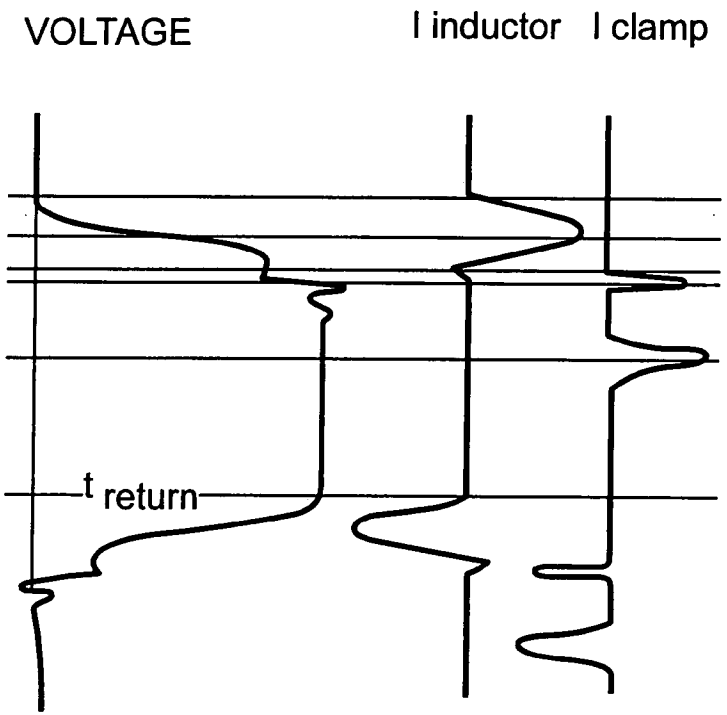
FIG. 2A PRIOR ART
FIG. 2A illustrates a complete cycle of voltage and current waveforms generated by the driver circuit shown in FIG. 1.
Figure 2:
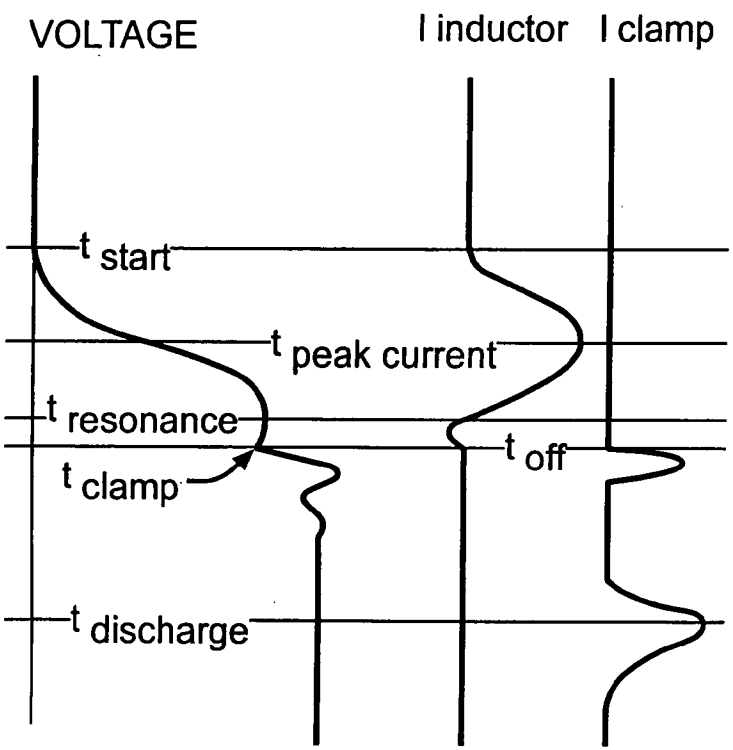
FIG. 2 PRIOR ART
FIG. 2 illustrates voltage and current waveforms generated by the driver circuit shown in FIG. 1.

During simulations, the inventor has determined that the improved circuit increased the peak ringing current from 27 amps needed for the same PDP with the prior art driver circuit 12 to 32 amps while reducing the power consumption from 42 watts to 27 watts. Additionally, the operating temperature of the switching devices was reduced from about 120° C. to about 90° C. Also significant is the smoothing of the voltage applied to the PDP 14, as illustrated in the bottom graph. The ringing in the voltage associated with the clamping action as shown in FIG. 2 for the prior art driver circuit has been eliminated.

The preceding results were obtained with the bridge timing set so that the resonant transition was well completed before activation of the clamps. Setting the clamping time close to the completion of the resonant transition can increase the sustainer losses by about 35%. The inventor found that the temperature of the MUR1540 diode junctions during reverse-recovery can adversely effect their turn-off time and thereby lower the efficiency.

After making these measurements, the inventor also investigated improvements to the gate drive voltage for the resonant switches 32 and 34. The measured value was between 12 and 9V initially and the inventor believes that an increase will give a second-order improvement in circuit efficiency.

Figure 3:
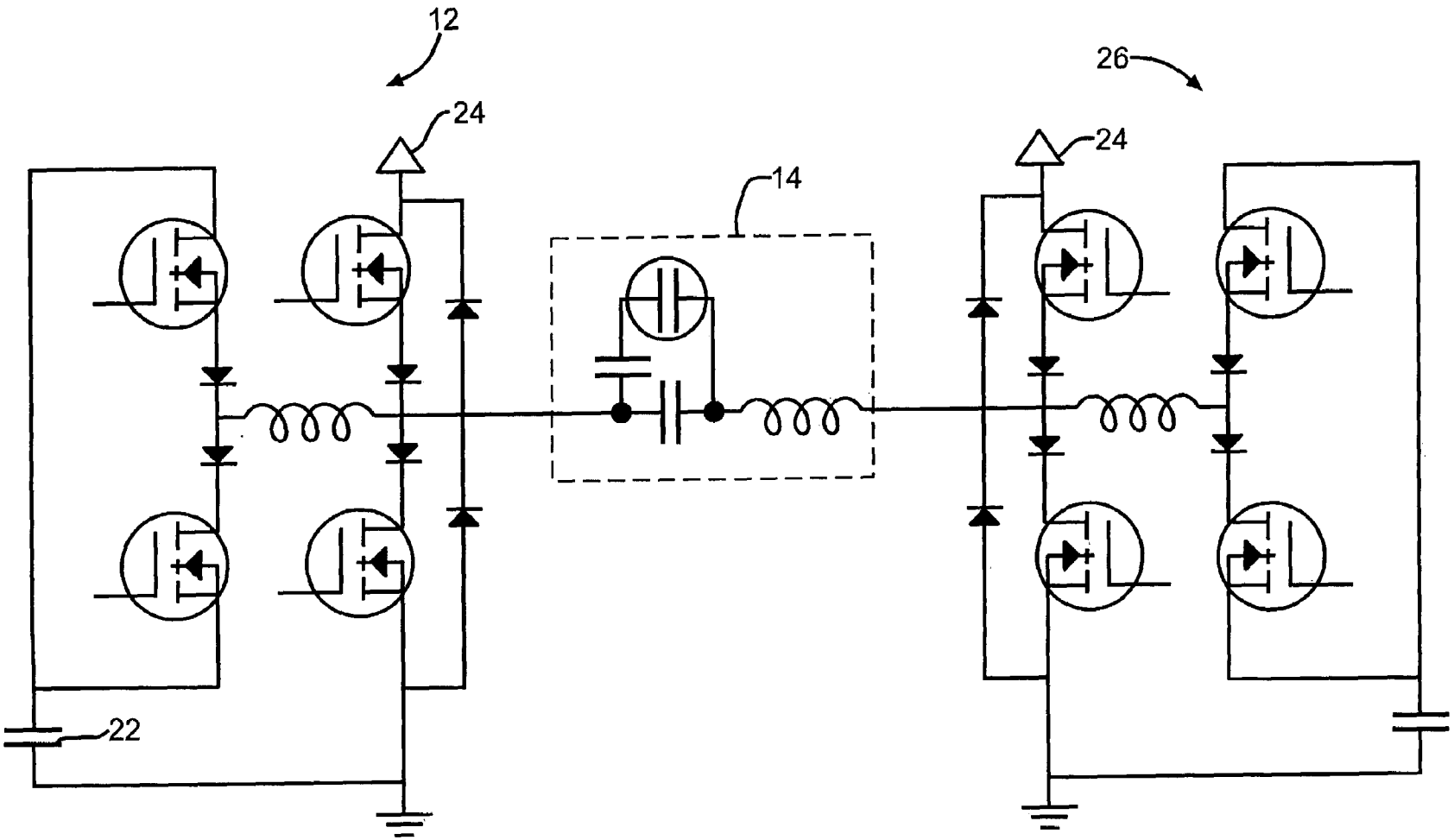
FIG. 3 PRIOR ART
FIG. 3 is a schematic diagram for a complete driver circuit that includes the section shown in FIG. 1.
Figure 6:
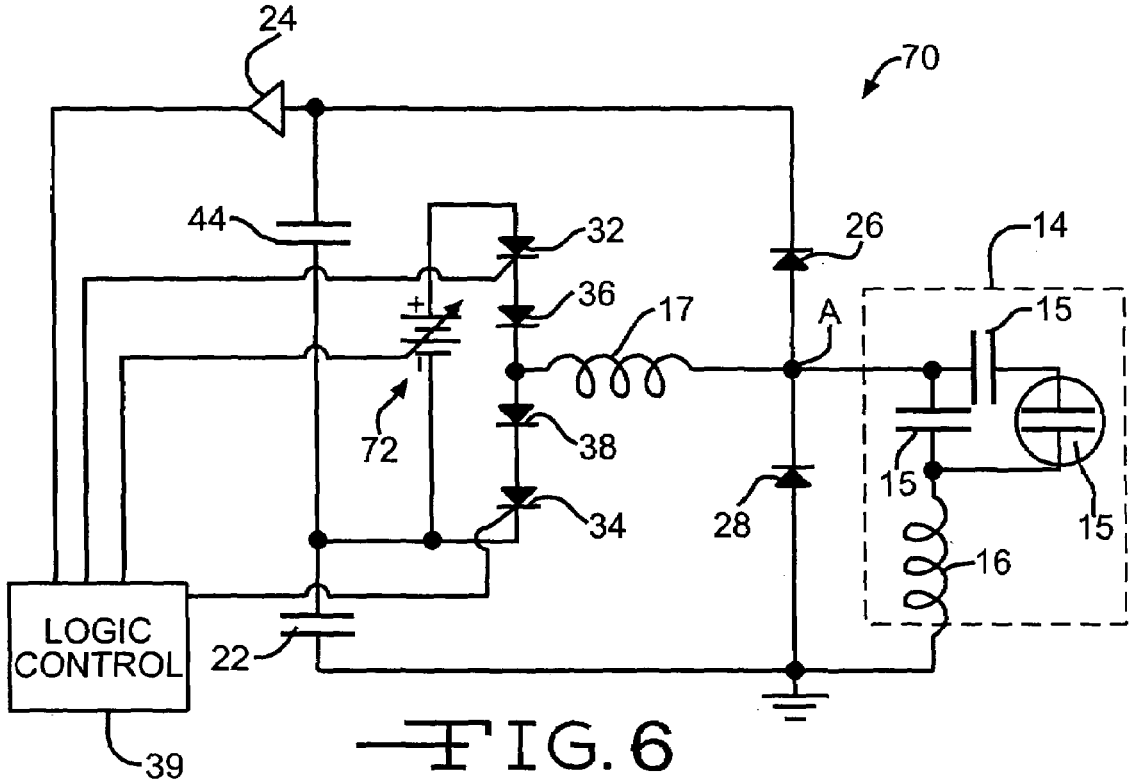
FIG. 6 is a schematic diagram for an alternate embodiment of the driver circuit section shown in FIG. 5.
Figure 7:
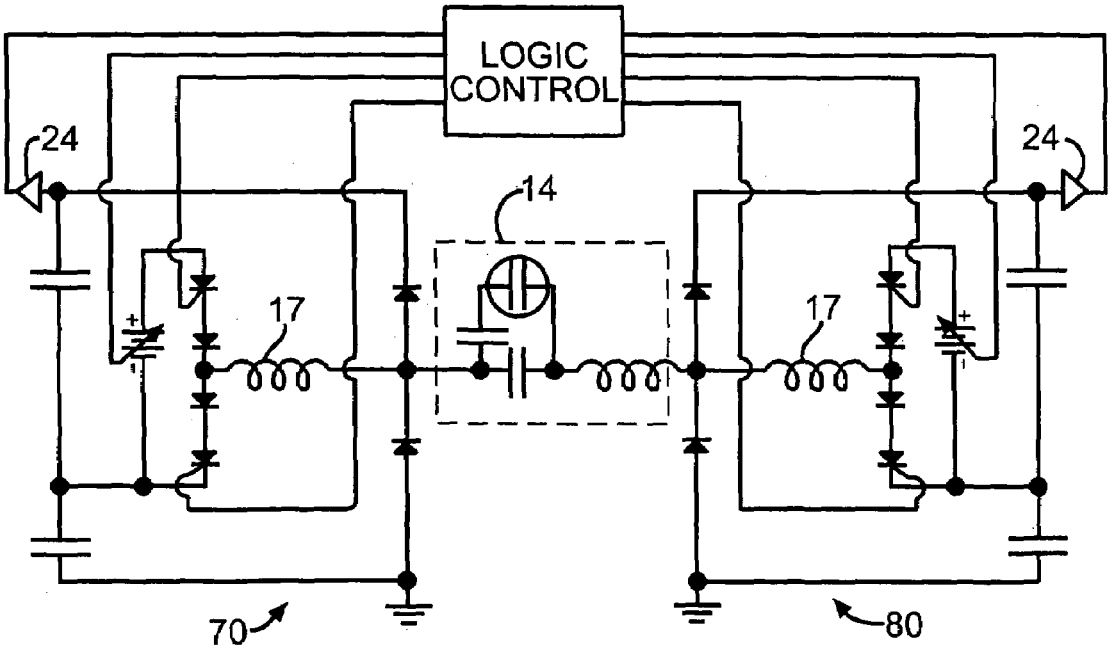
FIG. 7 is a schematic diagram for a complete driver circuit that includes the circuit driver section shown in FIG. 5.

An alternate embodiment of the improved driver circuit is illustrated at 70 in FIG. 6. Components shown in FIG. 6 that are similar to components shown in FIG. 4 have the same numerical designators. In the alternate embodiment, the two variable voltage supplies 40 and 42 have been replaced with a single variable voltage supply 72. The positive terminal of the supply 72 is connected to the anode of the first IGBT 32 while the negative terminal of the supply 52 is connected to the cathode of the second IGBT 34. Thus, the alternate embodiment of the circuit 70 uses less components than the embodiment illustrated in FIG. 4. The operation of the alternate embodiment 70 is the same as described above; however, the circuit 70 is equivalent to one section of the prior art circuit shown in FIG. 3. Thus the driver circuit 70 is only capable to increase the sustainer voltage. A second driver circuit 80, which is shown in FIG. 7 is needed to return the sustainer voltage to the original level.

The invention further contemplates replacement of the MUR1540 series diodes 36 and 38 with faster diodes. It is believed that faster diodes will improve the resonant transition, while decreasing both losses in the clamping bridge as well as switching losses in the circuit.

Figure 8:
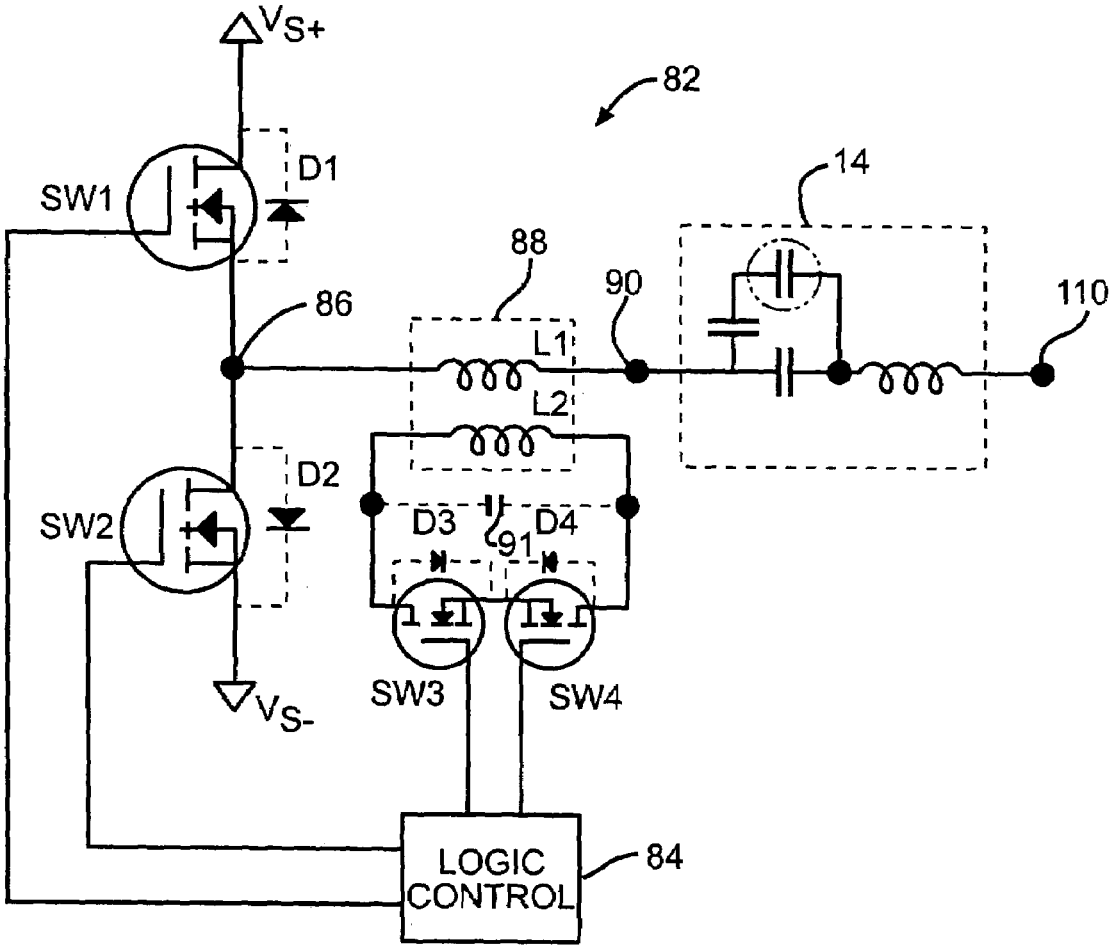
FIG. 8 is a schematic diagram for a section of an alternate embodiment of the driver circuit shown in FIG. 4.

The invention also contemplates another alternate embodiment 82 of the driver section circuits, as illustrated by the schematic circuit diagram shown in FIG. 8. As before, components in FIG. 8 that are similar to components shown in earlier figures have the same numerical identifiers. As shown in FIG. 8, the alternate embodiment 82 includes a first pair of electronic switches, SW1 and SW2, that are connected in series between voltage supplies $V_{S1}$ and $V_{S2}$. While FET's are shown for the electronic switches, SW1 and SW2, it will be appreciated that the use of FET's is exemplary and that other the invention also can be practiced with other switching devices. The diodes, D1 and D2 shown with dashed lines represent the internal characteristics of the FET's. The gates of the FET's are connected to a logic control 84 that is operational to switch the FET's between their conducting and non-conducting states. The voltage supplies $V_{S+}$ and $V_{S-}$ have fixed output voltages set at the ±the sustaining voltage value for the PDP 14 that is driven by the circuit 82. While the sustaining voltages are shown as being plus/minus, it will be appreciated that voltages are measured from a reference voltage value that can be selected as non-zero.

The common connection point 86 between the electronic switches, SW1 and SW2, is connected through a transformer 88 to a first input port 90 of the PDP 14. In the preferred embodiment, the transformer 88 is an air core transformer having a primary winding L1 and secondary winding L2. The transformer windings are wound to match the equivalent capacitance of the PDP 14 and the desired PDP response time. Generally, the inductance of the transformer 88 is low to meet these criteria. The invention can be practiced with a transformer turns ratio of 1:1; however, selecting turns ratio that steps down the voltage in the secondary circuit allows use of lower voltage rating devices in the transformer secondary circuit. Accordingly, in the preferred embodiment, a step down voltage turns ration of 4:1 or 5:1 is used.

The secondary circuit of the transformer 88 is connected to a second pair of electronic switches SW3 and SW4, that are connected in series with one another. While FET's are again shown for the electronic switches, SW3 and SW4, it will be appreciated that the use of FET's is exemplary and that other the invention also can be practiced with other switching devices. The diodes, D3 and D4 shown with dashed lines represent the internal characteristics of the FET's. The gates of the FET's are connected to the logic control 84 that is operational to switch the FET's between their conducting and non-conducting states. While two lines are shown connecting the FET gates to the logic control 88, both FET,s, SW3 and SW4, are operated together and a single line (not shown) can be used to connect the logic control 84 to both FET gates. When the turns ratio for the transformer 88 is selected to step down the secondary voltage from the primary, lower voltage rated devices can be utilized for the second pair of electronic switches SW3 and SW4 than for the first pair of electronic switches SW1 and SW2, allowing a reduction in cost.

Figure 9:
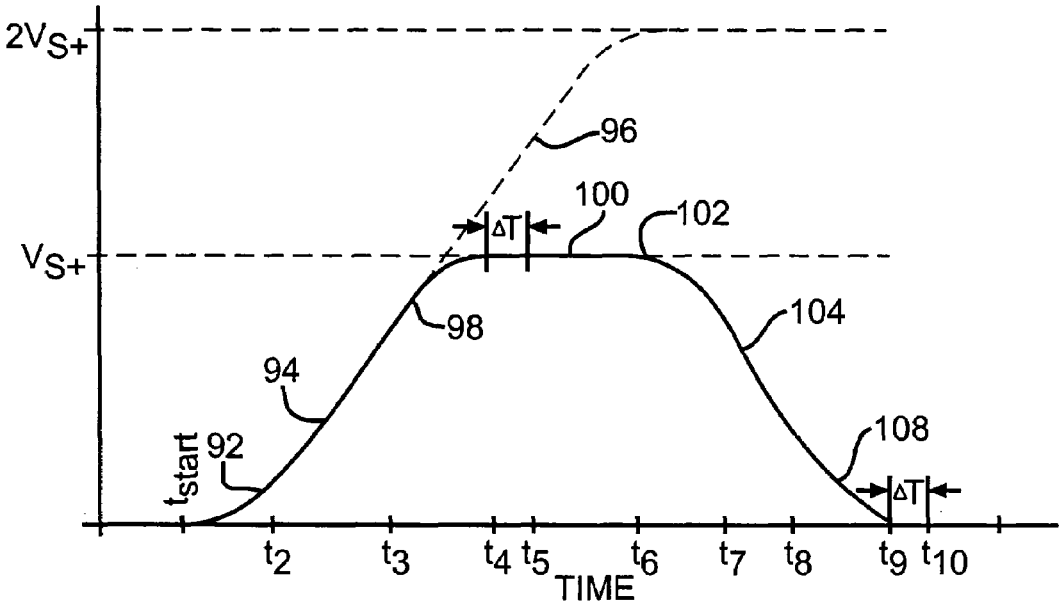
FIG. 9 illustrates voltage waveform generated by the driver circuit shown in FIG. 8.

The operation of the driver circuit 82 will now be explained with reference to FIGS. 9 and 10. FIG. 9 illustrates the sustaining voltage waveform generated by the circuit 82 and applied the first input port 90 of the PDP 14. The time sequencing for switching the electronic switches SW1, SW2, SW3 and SW4 in the driver circuit 82 is illustrated in FIG. 10 with the portion of the figure labeled 10*a* corresponding to the operation of electronic switch SW1 between its conducting and non-conducting states, which are indicated by the legends "on" and "off", respectively.

Initially, all four switches SW1, SW2, SW3 and SW4 are in their non-conducting state. At time $t_{start}$ the logic control 84 is operative to cause the upper switch SW1 of the first pair of electronic switches to change to its conducting state and thereby apply the voltage $V_{s+}$ to the first input port 90 of the PDP 14. Because of the inherent capacitance of the PDP 14, the voltage being applied to the PDP input port 90 begins increase, as shown by the portion of the curve labeled 92 in FIG. 9, as the series resonance of the transformer primary coil L1 and the parallel capacitors of the PDP 14 establish a resonant rise in voltage at the input port 90 of the PDP 14. The total energy injected into the resonant circuit is sufficient to both transition the voltage across the PDP 14, which appears as a capacitance to the driver circuit 82, to the desired sustainer voltage level; and to provide sufficient current to establish the required gas discharges within the PDP 14. When time reaches $t_2$, the logic control 84 is further operative to cause the upper switch SW1 of the first pair of electronic switches to change to its non-conducting state. However, the voltage at the PDP input port 92 continues to increase as shown by the portion of the curve labeled 94 in FIG. 9 and, if nothing further would happen the voltage at the PDP input port 92 would follow the dashed line labeled 96, to a value of approximately $2V_{s+}$.

To control the voltage applied to the PDP 14, the logic control 84 again causes the upper switch SW1 of the first pair of electronic switches to change to its conducting state at $t_3$ while also causing the second pair of electronic switches SW3 and SW4 in the transformer secondary circuit to change to their conducting state. With the FET's shown in the secondary circuit in FIG. 8, only one FET actually conducts while the internal diode of the other FET allows the secondary current to flow. However, the configuration of the second pair of FET's allows the secondary current to flow in either direction as the needed by the voltage being applied to the PDP 14. As the secondary current flows, energy is stored in the B-field generated by the transformer 88. As a result, the increasing voltage applied to the PDP input port 90 is clamped to a steady value of about $V_{S+}$, as shown by the portion of the curve labeled 98 in FIG. 9.

Figure 10A:
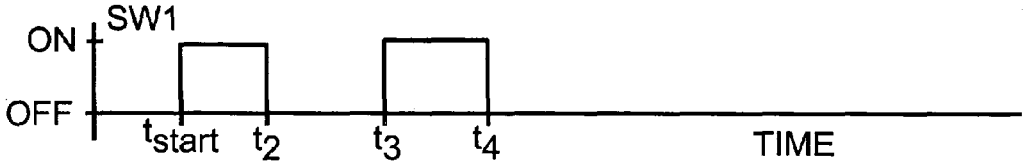
FIG. 10 illustrates the switching sequence used by the switches in the circuit diagram shown in FIG. 8 to generate the voltage waveform shown in FIG. 9.
Figure 10B:
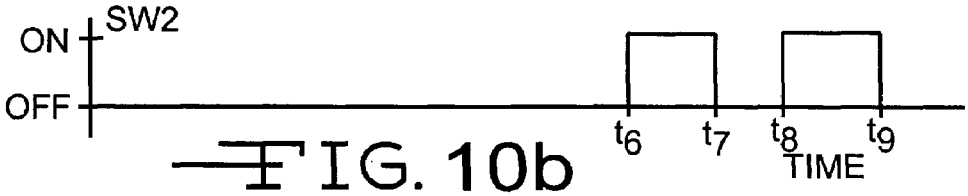
Figure 10C:
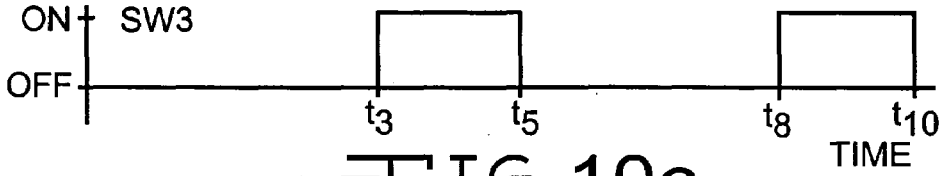
Figure 10D:
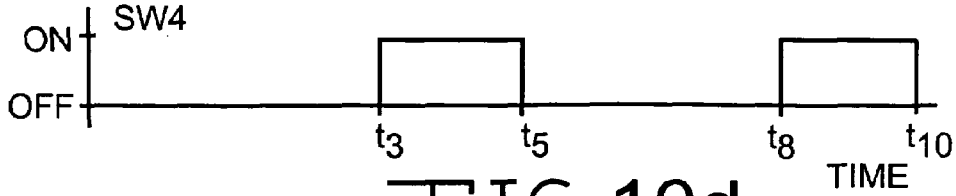

At $t_4$, the logic control 84 causes the upper switch SW1 of the first pair of electronic switches to change back to its non-conducting state, as shown in FIG. 10*a*, while the second pair of electronic switches SW3 and SW4 in the transformer secondary circuit remain in their conducting state until time $t_5$, as shown in FIGS. 10*c* and 10*d*. There is sufficient energy stored in the B-field with the secondary current that energy is prevented from being discharged within the PDP 14 between the times $t_4$ and $t_5$. The duration of the time period between the times $t_4$ and $t_5$ is labeled ΔT and is selected to provide appropriate conditions and voltage phase relationships for the PDP 4.

The voltage applied to the PDP input port 90 can be further controlled by adding an optional capacitor 94 in the transformer secondary circuit and across the second pair of electronic switches SW3 and SW4, as illustrated with dashed lines in FIG. 8. The optional capacitor 94 forms a resonant circuit with transformer secondary inductance L2. Between $t_5$ and $t_6$, all of the electronic switches SW1, SW2, SW3 and SW4 are again in their non-conducting state and the voltage at the PDP input port 90 remains at approximately $V_{S+}$, as shown by the portion of the curve in FIG. 9 labeled 100.

Beginning at $t_6$, the voltage at the PDP input port 90 is returned to the initial voltage level by further operation of the electronic switches. At $t_6$, the logic control 84 is operative to cause the lower switch SW2 of the first pair of electronic switches to change to its conducting state and thereby apply the voltage $V_{S-}$ to the first input port 90 of the PDP 14. Because of the inherent capacitance of the PDP 14, the voltage begins applied to the PDP input port 90 begins decrease, as shown by the portion of the curve labeled 102 in FIG. 9. When time reaches $t_7$, the logic control 84 is further operative to cause the lower switch SW1 of the first pair of electronic switches to change to its non-conducting state. However, the voltage at the PDP input port 92 continues decrease as shown by the portion of the curve labeled 104 in FIG. 9 and, if nothing further would happen would continue to decrease to a value of approximately $2V_{S-}$.

To continue to control the voltage applied to the PDP 14, the logic control 84 again causes the lower switch SW2 of the first pair of electronic switches to change to its conducting state at $t_8$ while also causing the second pair of electronic switches SW3 and SW4 in the transformer secondary circuit to change to their conducting state. With the voltage decreasing, the secondary current now flows in the opposite direction from the flow during the increasing voltage portion of the PDP driver circuit operation described above. However, as described above, the configuration of the second pair of FET's allows the secondary current to flow in either direction as the needed by the voltage being applied to the PDP 14. As the secondary current flows, energy is again stored in the B-field generated by the transformer 88. As a result, the decreasing voltage applied to the PDP input port 90 is clamped to a steady value of about the initial voltage, as shown by the portion of the curve labeled 108 in FIG. 9.

At $t_9$, the logic control 84 causes the lower switch SW2 of the first pair of electronic switches to change back to its non-conducting state, as shown in FIG. 10*a*, while the second pair of electronic switches SW3 and SW4 in the transformer secondary circuit remain in their conducting state until time $t_{10}$, as shown in FIGS. 10*c* and 10*d*. There is sufficient energy stored in the B-field with the secondary current that energy is prevented from being discharged with in the PDP 14 between the times $t_9$ and $t_{10}$. The duration of the time period between the times $t_9$ and $t_{10}$ is labeled ΔT' and is selected to provide appropriate conditions and voltage phase relationships for the PDP 4. The invention contemplates that the duration ΔT' may or may not be equal to ΔT.

The invention further contemplates that the energy remaining in the PDP 14 is monitored during the driver circuit cycle described above. A feedback circuit (not shown) would determine the magnitude of any residual energy remaining in the PDP 14 when the input port voltage is returned to its initial value and the sustaining voltage adjusted during the next cycle to compensate for the remaining energy by supplying less energy to the PDP 14. The compensation can take several forms. For example the time periods during which the sustaining voltage is applied to the PDP 14 can be reduced. Alternately, a PWM voltage can be used for the sustaining voltage, in which case the duty cycle of the PWM waveform can be modified to reduce, or increase, the energy supplied to the PDP 14. Additionally, a combination of changing the time period and PWM modulation can be utilized.

Additionally, as described above, the total energy injected into the resonant circuit is sufficient to both transition the voltage across the PDP 14, which appears as a capacitance to the driver circuit 82, to the desired sustainer voltage level; and to provide sufficient current to establish the required gas discharges within the PDP 14. Accordingly, the logic control 84 also is connected to the PDP control circuit (not shown). The logic control 84 receives information from the PDP control circuit concerning the percentage of the PDP 14 that is to be illuminated by gas discharges. Since the current required for establishing the gas discharges is proportional to the amount of the PDP to be illuminated, the logic control 84 is operable to convert the percentage to a current demand and then adjust the waveform PWM and/or on times to assure that sufficient energy is injected into the PDP 14 to provide both the desired sustainer voltage level and the current needed to establish the desired gas discharges.

Similar to the driver circuits shown above, the PDP 14 in FIG. 8 has a second input port 110 that is connected to a second driver circuit (not shown) that is a mirror image of the driver circuit 82 described above. The second driver circuit is operative to provide a sustaining voltage to the PDP 14 that is the inverse of the voltage waveform shown in FIG. 9.

Figure 11:
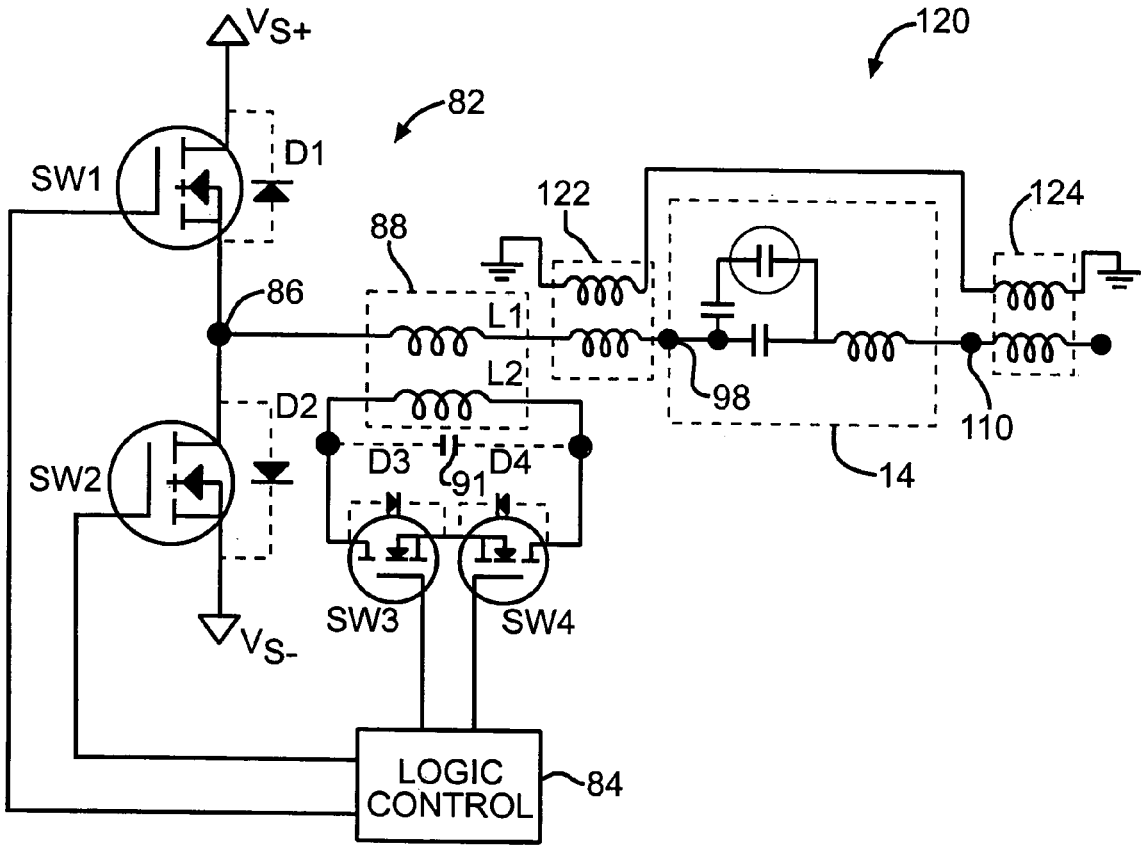
FIG. 11 is an alternate embodiment of the circuit shown in FIG. 8.

Another alternate embodiment of the driver circuit is shown generally at 120 in FIG. 11. As before, components in FIG. 11 that are similar to components shown in the preceding figures have the same numerical designators. The driver circuit 120 includes a second air core transformer 122 having a primary coil that is connected between the PDP input port 90 and the first driver circuit 82. The driver circuit 120 also has a third air core transformer 124 having a primary coil that is connected between the PDP output port 110 and the second driver circuit (not shown). One end of each of the secondary coils of the second and third transformers 122 and 124 are connected together while the other ends of the secondary coils are connected to ground. The additional transformers allow balancing of the voltages applied to the two PDP ports 90 and 110 by transferring energy across the PDP 14 by means of the current flowing between the transformer secondary coils.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A sustainer voltage driver circuit for a flat plasma display panel comprising:

a driver inductor having at least a first end and a second end, said second end of said inductor adapted to be connected to an input port of the flat plasma display panel;

a first electronic switch connected to said first end of said driver inductor;

a second electronic switch also connected to said first end of said driver inductor;

at least one variable voltage supply connected across said first and second electronic switches;

a first driver capacitor connected between said second electronic switch and ground;

a second driver capacitor connected between said second electronic switch and a voltage feedback point;

a first driver diode connected between said second end of said driver inductor and said voltage feedback point;

a second driver diode connected between said second end of said driver inductor and ground; and a logic circuit connected to and operative to control said first and second electronic switches and said variable voltage supply.

2. The driver circuit according to claim 1 wherein when the driver circuit is connected to a plasma display panel the circuit resonates with the panel such that the total power required to operate the panel is reduced.

3. The driver circuit according to claim 1 wherein said first and second electronic switches include a series connection of an Injection Gate Bipolar Transistor and a diode.

4. The driver circuit according to claim 1 wherein said logic circuit also is connected to said feedback point and is responsive to the voltage level at said voltage feedback point to adjust the output voltage level of said voltage supply.

5. The driver circuit according to claim 4 wherein said logic circuit is operative to set said variable voltage supply at an appropriate level to inject sufficient energy during a transition of a sustaining voltage to a resonant condition to establish a plasma discharge within the flat plasma display panel.

6. A sustainer voltage driver circuit for a flat plasma display panel comprising:

a driver inductor having a first end and a second end, said second end of said inductor adapted to be connected to an input port of the flat plasma display panel;

a first electronic switch connected between said first end of said driver inductor and a first terminal of a first variable voltage supply, said first variable voltage supply also having a second terminal;

a second electronic switch connected between said first end of said driver inductor and a second terminal end of a second variable voltage supply, said second variable voltage supply also having a first terminal that is connected to said second terminal of said first variable voltage supply;

a first driver capacitor connected between said first terminal of said second variable voltage supply and ground;

a second driver capacitor connected between said first terminal of said second variable voltage supply and a voltage feedback point;

a first driver diode connected between said second end of said driver inductor and a voltage feedback point;

a second driver diode connected between said second end of said driver inductor and ground; and a logic circuit connected to and operative to control said first and second electronic switches and said variable voltage supplies.

7. The driver circuit according to claim 6 wherein when the driver circuit is connected to a plasma display panel the circuit resonates with the panel such that the total power required to operate the panel is reduced.

8. The driver circuit according to claim 6 wherein said first and second electronic switches include a series connection of an Injection Gate Bipolar Transistor and a diode.

9. The driver circuit according to claim 6 wherein said logic circuit also is connected to said feedback point and is responsive to the voltage level at said voltage feedback point to adjust the output voltage level of said voltage supply.

10. The driver circuit according to claim 9 wherein said logic circuit is operative to set said variable voltage supply at an appropriate level to inject sufficient energy during a transition of a sustaining voltage to a resonant condition to establish a plasma discharge within the flat plasma display panel.

11. A method for operating a flat plasma display panel driver circuit comprising the steps of:

(a) providing a driver circuit that includes:

(1) a driver inductor having at least a first end and a second end, said second end of said inductor adapted to be connected to an input port of the flat plasma display panel;

(2) a first electronic switch connected to said first end of said driver inductor;

(3) a second electronic switch also connected to said first end of said driver inductor;

(4) at least one adjustable voltage supply connected across said first and second electronic switches;

(5) a first driver capacitor connected between said second electronic switch and ground;

(6) a second driver capacitor connected between said second electronic switch and a voltage feedback point;

(7) a first driver diode connected between said second end of said driver inductor and said voltage feedback point;

(8) a second driver diode connected between said second end of said driver inductor and ground; and (9) a logic circuit connected to and operative to control said first and second electronic switches and said variable voltage supply;

(b) determining an energy requirement for the display panel;

(c) setting voltage supply levels to correspond to the desired energy requirement;

(d) beginning transition to a resonant condition for the sustaining voltage; and (e) if desired, supplying sufficient energy during the transition stage to establish a plasma discharge within the flat plasma display panel.

12. The method according to claim 11 wherein during step (c) the voltage driver power supplies are set at an appropriate level to inject sufficient energy during a transition to a resonant condition to establish a plasma discharge.

13. The method according to claim 12 further including, subsequent to step (e), feeding back the sustaining voltage level and, if necessary, adjusting the voltage supply levels.

14. A sustainer voltage driver circuit for a flat plasma display panel comprising:

a first electronic switch having a first end and a second end, said first electronic switch operable to be switched between conducting and non-conducting states;

a first fixed sustainer voltage supply connected to said first end of said first electronic switch;

a second electronic switch having a first end and a second end, said second electronic switch operable to be switched between conducting and non-conducting states, said first end of said second electronic switch being connected to said second end of said first electronic switch;

a second fixed sustainer voltage supply having a polarity opposite to said first sustainer voltage supply connected to said second end of said second electronic switch;

a transformer having a primary coil and secondary coil, one end of said transformer primary coil being connected to said second end of said first electronic switch, the other end of said transformer primary coil being adapted to be connected to the flat plasma display panel;

a pair of electronic switches connected in series, said pair of electronic switches being operable to be switched between conducting and non-conducting states, said series connection of said pair of electronic switches being connected across said transformer secondary coil; and a logic control connected to said electronic switches, said logic control being operable to switch said electronic switches between their conducting and non-conducting states to apply said sustainer voltages to the flat plasma display panel and to inject sufficient energy into the panel during a resonant condition to establish a plasma discharge within the panel.

15. The driver circuit according to claim 14 wherein the injected energy is sufficient to both transition the voltage across the flat plasma display panel to a desired sustainer voltage level and to provide current to initiate desired gas discharges within the flat plasma display panel.

16. The driver circuit according to claim 15 wherein said logic control is connected to a control circuit for the flat plasma display panel and receives information from said display panel control circuit concerning the extent of desired illumination to the panel, said control circuit being responsive to said display panel information to adjust the amount of energy injected into the display panel to assure that voltage across the panel is transitioned to said desired sustainer voltage level and that there also is sufficient current to initiate said desired gas discharges within the flat plasma display panel.

17. The driver circuit according to claim 15 wherein said logic control switches said pair of electronic switches connected to said transformer secondary coil while voltage is applied to the flat plasma display panel to store energy within the field generated by said transformer coils, said stored energy being injected into the flat plasma display panel at an appropriate time.

18. The driver circuit according to claim 17 wherein the driver circuit is a first driver circuit and further including a second driver circuit that is a mirror image of the first driver circuit, said second driver circuit also connected to the flat plasma display panel for driving the flat plasma display panel with opposite sustainer voltages.

19. The driver circuit according to claim 18 further including a pair of secondary transformers, each of said secondary transformers having a primary coil connected between one of the driver circuits and the flat plasma display panel, said secondary transformers having one end of their secondary coils connected together and the other ends of their secondary coils connected to ground whereby the voltages applied to flat plasma display panel by the first and second driver circuits are balanced.

20. The driver circuit according to claim 17 wherein said electronic switches are field effect transistors.

21. The driver circuit according to claim 17 wherein said transformer is an air core transformer.

22. The driver circuit according to claim 17 further including a feedback circuit adapted to monitor the amount of energy delivered to the flat plasma display panel, said feedback circuit operable to adjust the operation of said logic control to vary the amount of energy delivered to the flat panel display during operation of the driver circuit.

23. The driver circuit according to claim 17 wherein the voltage applied to the flat plasma display panel is a pulse width modulated voltage having an adjustable duty cycle and further wherein the driver circuit includes a feedback circuit adapted to monitor the amount of energy delivered to the flat panel plasma display, said feedback circuit further operable to adjust the duty cycle of the pulse width modulated voltage supplied to the flat panel display to vary the amount of energy delivered to the flat panel display during operation of the driver circuit.

24. The driver circuit according to claim 17 further including a capacitor connected across said transformer secondary coil, said capacitor forming a resonant circuit with said transformer secondary coil.

25. A method for operating a flat plasma display panel comprising the steps of:

(a) supplying a driver circuit having a first switching device adapted to connect a sustaining voltage supply to the flat plasma display panel with a primary coil of a transformer connected between the driver circuit and the display panel, the secondary transformer coil being connected across a second switching device;

(b) placing the first switching device in a conducting state while the second switching device is in a non-conducting state to cause a voltage to begin to increase at a generally increasing rate upon the display panel;

(c) placing the first switching device in a non-conducting state while the second switching device is in a non-conducting state to cause the voltage upon the display panel to continue to increase at a generally constant rate;

(d) returning the first switching device to a conducting state while also placing the second switching device in a conducting state to cause the voltage upon the display panel to continue to increase at a slower rate and to be clamped at predetermined voltage level while energy is stored within the magnetic field established in the transformer coils by the flow of current within the transformer secondary coil;

(e) placing the first switching device in a non-conducting state while the second switching device remains in a conducting state to continue to store energy within magnetic field established in the transformer coils by the flow of current within the transformer secondary coil; and (f) returning the second switching device to a non-conducting state to inject the stored energy into the display panel while maintaining the voltage applied to the flat plasma display panel at essentially a clamped voltage level.

26. The method according to claim 25 wherein the injected energy is sufficient to both transition the voltage across the flat plasma display panel to a desired sustainer voltage level and to provide current to initiate the desired gas discharges within the flat plasma display panel.

27. The method according to claim 26 wherein the switching devices include field effect transistors and a logic control connected to the field effect transistors, the logic control operative to selectively switch the field effect transistors between their conducting and non-conducting states.

28. The method according to claim 26 wherein the transformer is an air core transformer.

29. A sustainer voltage driver circuit for a flat plasma display panel comprising:

a first switching device having a first end and a second end, said first end adapted to be connected to a sustaining voltage supply;

a transformer having a primary winding and a secondary winding, said primary winding having a first end and a second end, said first end of said primary winding being directly connected to said second end of said first switching device, said second end of said primary winding being adapted to be connected to a sustaining voltage input port of the flat plasma display panel; and a second switching device connected across said secondary winding of said transformer, said first and second switching devices being selectively switched between conducting and non-conducting states such that energy is stored in a field generated by said transformer windings for injection into the plasma display panel.

30. The driver circuit according to claim 29 wherein the injected energy is sufficient to both transition the voltage across the flat plasma display panel to a desired sustainer voltage level and to provide current to initiate the desired gas discharges within the flat plasma display panel.

31. The driver circuit according to claim 30 wherein said first and second switching devices are selectively switched between conducting and non-conducting states such that the voltage applied to the flat plasma display panel increases and is clamped at a voltage level corresponding to the output of the first sustainer voltage supply.

32. The driver circuit according to claim 30, wherein said first and second switching devices each include at least one electronic switch.

33. The driver circuit according to claim 32 wherein said transformer is an air core transformer.

34. A sustainer driver circuit for a flat plasma display panel comprising:

a first sustaining voltage supply;

a first switching device having a first end and a second end, said first end adapted to be connected to a first sustaining voltage supply;

a transformer having a primary winding and a secondary winding, said primary winding having a first end and a second end, said first end of said primary winding being connected to said second end of said first switching device, said second end of said primary winding being adapted to be connected to a sustaining voltage input port of the flat plasma display panel;

a second switching device connected across said secondary winding of said transformer, said first and second switching devices being selectively switched between conducting and non-conducting states such that energy is stored in a field generated by said transformer windings for injection into the plasma display panel with said injected energy being sufficient to both transition the voltage across the flat plasma display panel to a desired sustainer voltage level and to provide current to initiate the desired gas discharges within the flat plasma display panel; and a third switching device having first and second ends, said first end of said third switching device being connected to said second end of said first switching device and said second end of said third switching device adapted to be connected to a second sustaining voltage supply, said second sustaining voltage supply having a polarity that is opposite from the polarity of said first sustaining voltage supply, said third and second switching devices being selectively switched between conducting and non-conducting states such that energy is stored in a field generated by said transformer windings for injection into the plasma display panel and that the voltage applied to the flat plasma display panel decreases and is clamped at a voltage level corresponding to the initial voltage level or the display panel.

* * * * *